US007547238B1

(12) United States Patent
Melancon

(10) Patent No.: US 7,547,238 B1
(45) Date of Patent: Jun. 16, 2009

(54) FLOATABLE WATER BOARD WITH UNDERWATER VIEWING ASSEMBLY

(76) Inventor: Michel Melancon, 2730 Bourgogne, Brossard, Quebec (CA) J4Z 1T5

( * ) Notice: Subject to any disclaimer, the term of this patent is extended or adjusted under 35 U.S.C. 154(b) by 0 days.

(21) Appl. No.: 12/049,539

(22) Filed: Mar. 17, 2008

(51) Int. Cl.
*B63C 11/00* (2006.01)

(52) U.S. Cl. ..... 441/135

(58) Field of Classification Search ..... 441/135
See application file for complete search history.

(56) References Cited

U.S. PATENT DOCUMENTS

| | | | | |
|---|---|---|---|---|
| 2,075,649 | A | 3/1937 | Knight | |
| 2,717,399 | A | 9/1955 | Backhouse | |
| D189,273 | S | 11/1960 | Saeman | |
| 3,042,945 | A | 7/1962 | Saeman | |
| D221,697 | S | 8/1971 | Nickolson | |
| 3,619,042 | A | 11/1971 | Lazar | |
| D233,904 | S | 12/1974 | Dage | |
| 4,723,329 | A | 2/1988 | Vaccaro | |
| 4,844,595 | A * | 7/1989 | Nealy | 359/895 |
| 4,876,756 | A | 10/1989 | Vaccaro | |
| 4,925,417 | A | 5/1990 | Warren | |
| D315,387 | S | 3/1991 | Warren | |
| 5,476,055 | A * | 12/1995 | Hackett et al. | 114/66 |
| D377,072 | S | 12/1996 | Dejay | |
| 6,241,569 | B1 | 6/2001 | Harkrider | |
| 6,572,424 | B2 | 8/2002 | Harkrider | |
| D503,206 | S | 3/2005 | Debold | |
| D509,470 | S | 9/2005 | Weir | |
| D544,061 | S | 6/2007 | Kuchler | |

FOREIGN PATENT DOCUMENTS

| | | |
|---|---|---|
| DE | 3221711 | 12/1983 |

* cited by examiner

*Primary Examiner*—Jesus D Sotelo
(74) *Attorney, Agent, or Firm*—Ogilvy Renault LLP

(57) ABSTRACT

A floatable water board for supporting at least an upper body portion of a user person lying on the board when in a body of water is described. The board is formed of a flotation body constructed of buoyant material. The flotation body defines a bow end portion, a stern end portion, a top surface, and a bottom surface. A viewing cavity is provided in the flotation body and disposed at a predetermined location in a forward region of the flotation body. A transparent pane is sealingly retained at a bottom end of the viewing cavity and extends substantially in a plane of the bottom surface. An inflatable circumferential flotation collar assembly is secured about the cavity by a flexible and extendible section sealingly engaged about the viewing cavity and deployable above the top surface of the flotation body. The bottom surface of the flotation body is also provided with rails and channels to direct a water flow over the pane to evacuate any air bubbles which can impair visibility.

14 Claims, 5 Drawing Sheets

FLOATABLE WATER BOARD WITH UNDERWATER VIEWING ASSEMBLY

TECHNICAL FIELD

The present invention relates to a floatable water board for supporting at least an upper body portion of a user person on a body of water and wherein the water board is provided with a viewing cavity equipped with an inflatable circumferential flotation collar assembly deployable above the top surface of the water board about the cavity.

BACKGROUND ART

Various types of floatable water boards are known and which are provided with viewing areas whereby a user person propelling the board or simply floating on the board can be provided with underwater vision. Examples of such water boards are described and illustrated in U.S. Pat. Nos. 3,042,945; 4,925,417 and 6,572,424. A disadvantage of such viewing structures is that they are either too expensive to construct, do not provide clear vision due to water accumulating over the top surface of the viewing area or air bubbles form on the bottom surface of a viewing pane to impair clear vision or else air bubbles accumulate in a viewing cavity formed in the bottom surface of the board. Further, when these water boards are used on an unstable water surface due to wave activity, water is projected in the face of the user person or on a top pane of a viewing area impairing clear vision and often preventing the user person from access to the viewing area. There is therefore a need to provide a floatable water board having a viewing area which substantially overcomes the above-mentioned disadvantages.

SUMMARY OF INVENTION

It is a feature of the present invention to provide a floatable water board equipped with a viewing cavity and wherein an inflatable circumferential flotation collar assembly is secured about the cavity to shield the face of the user person as well as the cavity from water projected in the area of the viewing cavity thereby substantially overcoming all of the disadvantages of the prior art mentioned hereinabove.

Another feature of the present invention is to provide a floatable water board and wherein the upper end of the viewing cavity is protected by an inflatable circumferential flotation collar assembly secured about the cavity by a flexible and extendable section sealingly engaged about the viewing cavity and deployable above the surface of the floating body to prevent water from entering into the cavity.

A further feature of the present invention is to provide a floatable water board having a viewing cavity and wherein the bottom end of the viewing cavity has a transparent pane disposed substantially in a plane of the bottom surface of the water board and wherein the bottom surface is subjected to water flow to prevent the accumulation of air bubbles.

A further feature of the present invention is to provide a floatable water board having a viewing cavity and wherein an inflatable circumferential flotation collar assembly is storable within the cavity and detachably retained therein when not in use.

Another feature of the present invention is to provide a floatable water board having a viewing cavity with an inflatable circumferential flotation collar assembly secured about the cavity and wherein the flotation collar assembly has an inflatable ring-shaped tubular member which is secured about the cavity by a flexible and extendable sleeve to provide independent floating displacement of the ring-shaped inflatable tubular member with respect to the top surface of the water board.

According to the above features, from a broad aspect, the present invention provides a floatable water board for supporting at least an upper body portion of a user person lying on the board when in a body of water. The board is formed of a flotation body constructed of buoyant material. The flotation body defines a bow end portion, a stern end portion, a top surface, and a bottom surface. A viewing cavity is provided in the flotation body and disposed at a predetermined location in a forward region of the flotation body. A transparent pane is sealingly retained at a bottom end of the viewing cavity and extends substantially in a plane of the bottom surface. An inflatable circumferential flotation collar assembly is secured about the cavity by a flexible and extendible section sealingly engaged about the viewing cavity and deployable above the top surface of the flotation body.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
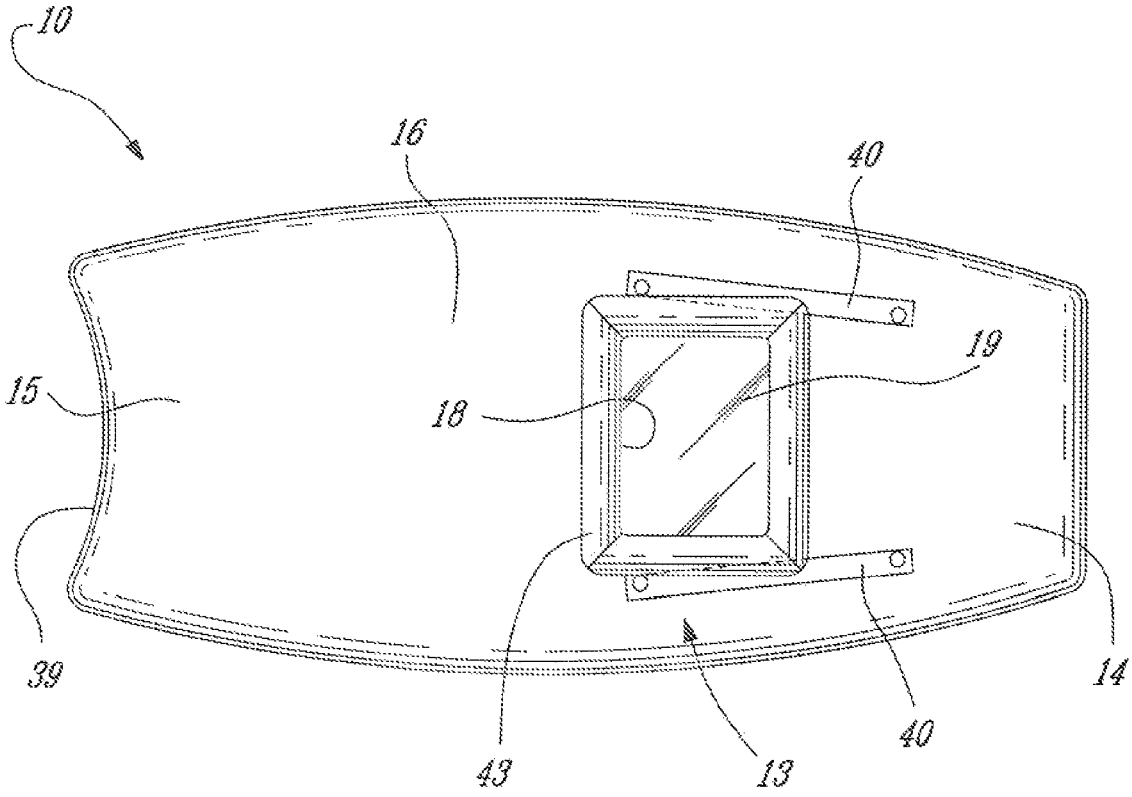
FIG. 1 is a top view of an embodiment of the floatable water board constructed in accordance with the present invention.
Figure 2:
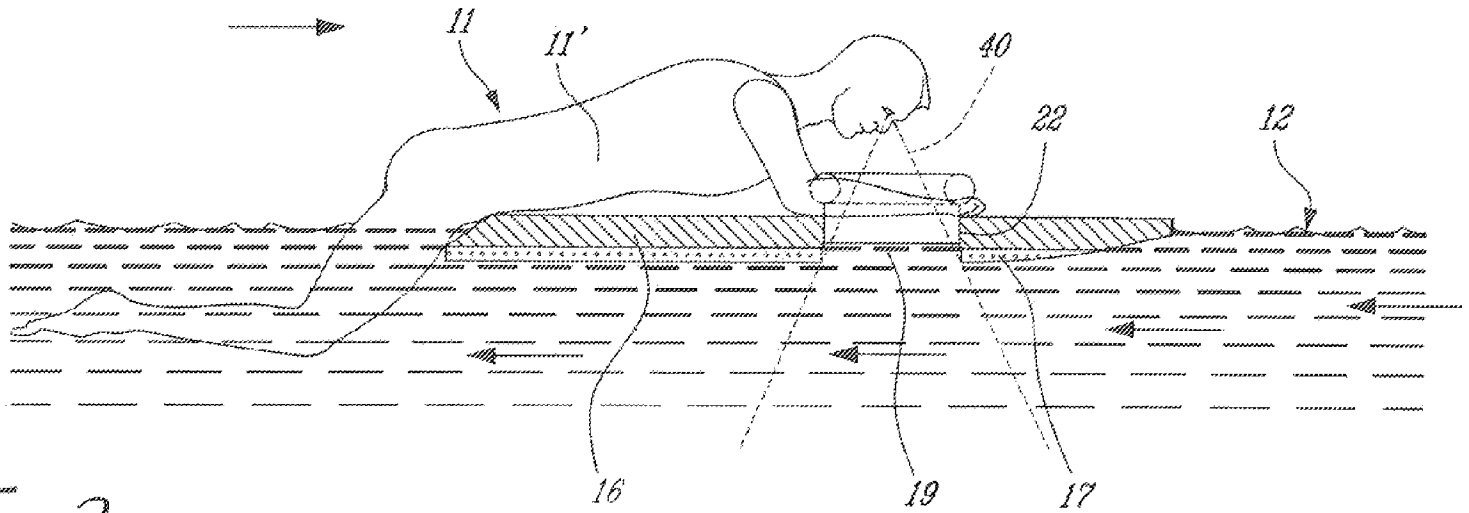
FIG. 2 is a longitudinal side section view of the water board of FIG. 1 shown in use by a user person on the top surface of a body of water.

Referring now to the drawings and more particularly to FIGS. 1 to 5, there is shown generally at 10 a floatable water board constructed in accordance with the present invention and for supporting at least an upper body portion 11' of a user person 11 lying on the board with the board floating on a body of water 12, as illustrated in FIG. 2. The floatable water board 10 is comprised of a flotation body 13 constructed of buoyant material such as foam material or flotation material covered with fiberglass or any, preferably lightweight, floating material. The flotation body 13 defines a bow end portion 14, a stern end portion 15, a top surface 16 and a bottom surface 17. A viewing cavity 18 is provided in the flotation body and extends from the top surface 16 to the bottom surface 17 and located at a predetermined location in a forward region of the flotation body as illustrated more clearly in FIG. 1. The cavity 18 is of rectangular outline but could be of any suitable shape.

A transparent pane 19 is sealingly retained at a bottom end of the viewing cavity 18 and extends substantially in a plane 20 of the bottom surface 17 of the board so as to form a flush bottom surface with the board. As better illustrated in FIGS. 4 and 5, an inflatable circumferential flotation collar assembly 21 has a flexible and extendable section 22 which is sealingly secured about the viewing cavity 18 by suitable attachment means, such as waterproof glue. The inflatable flotation collar assembly is provided with a ring-shaped inflatable tubular member 23 secured to an upper end of the flexible and extendable section 22 and is deployable above the top surface 16 of the flotation board 13 whereby to float on the upper surface of a body of water as more clearly illustrated in FIG. 3. The tubular member 23 provides a viewing port for the user person while preventing water form entering the cavity 18. It also provides a soft surface to prevent injury in the vicinity of the face of the user person.

Figure 3:
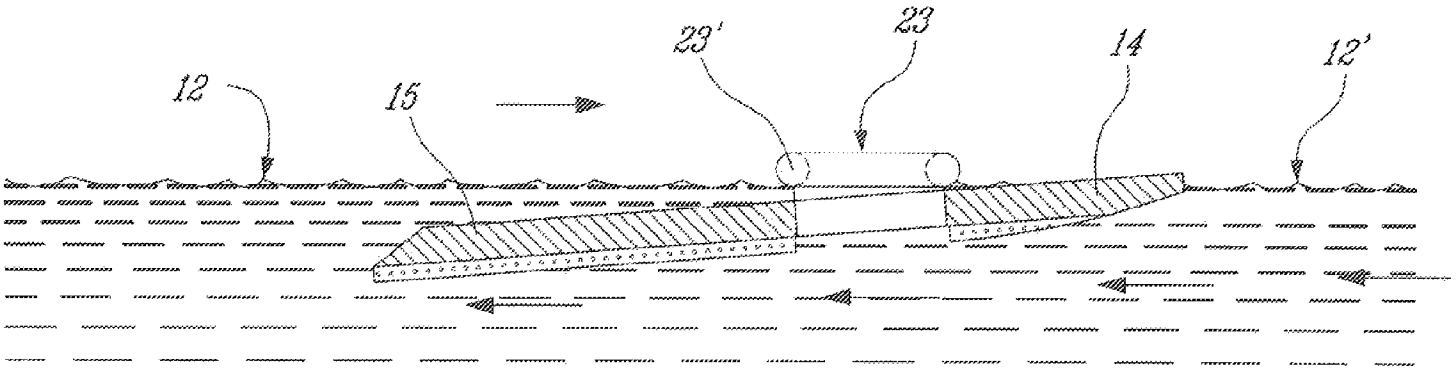
FIG. 3 is a further sectional side view showing the floatable water board in a position of use wherein the rear portion of the water board is submerged under the top surface of a body of water by the weight of a user person (not shown) and with the circumferential flotation collar floating on top of the body of water with the board at an angle with respect to the top surface of the water board.
Figure 6:
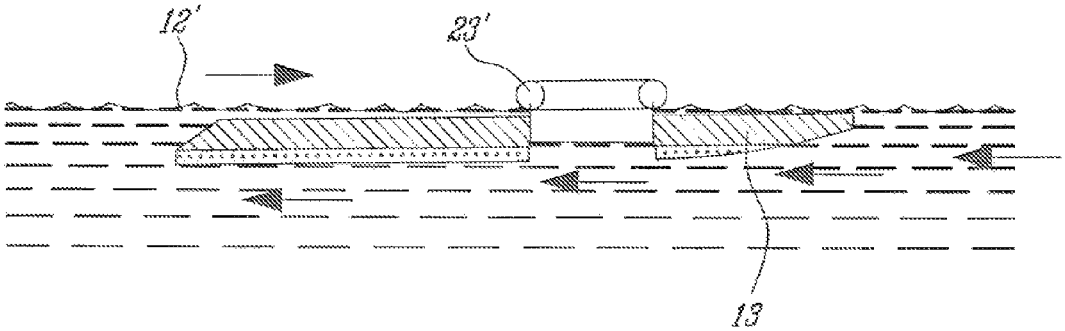
FIG. 6 is another sectional side view similar to FIG. 3, but showing the board completely submerged under the surface of a body of water by a user person (not shown)

The flexible and extendable section 22 is constituted by a sleeve of waterproof material such as plastics film material or treated canvas material, which, as above described, is sealingly secured at a bottom end thereof about the cavity 18 and also sealingly secured at an upper end thereof about the ring-shaped inflatable tubular member 23 whereby to constitute a sealed assembly about the viewing cavity. This flexible and extendable sleeve 22 provides independent floating displacement of the ring-shaped inflatable tubular member 23 with respect to the top surface of the flotation body whereby the tubular member 23 may remain on the top surface of the body of water while the flotation body is partly submerged under the top surface at various inclinations, as illustrated in FIG. 3. As shown in FIG. 3, the rear end section 23' of the board remains on the top surface 12' of the body of water 12 while the stern end portion 15 of the flotation body 13 is submerged thereunder while the collar member 23 remains floating on the top surface of the body of water. Therefore, water is prevented from entering into the viewing cavity by the collar member 23 regardless if the board is partly submerged under the surface of a body of water or fully submerged thereunder a distance not exceeding the full height of the flotation collar assembly when fully deployed, as illustrated in FIG. 6.

Figure 4:
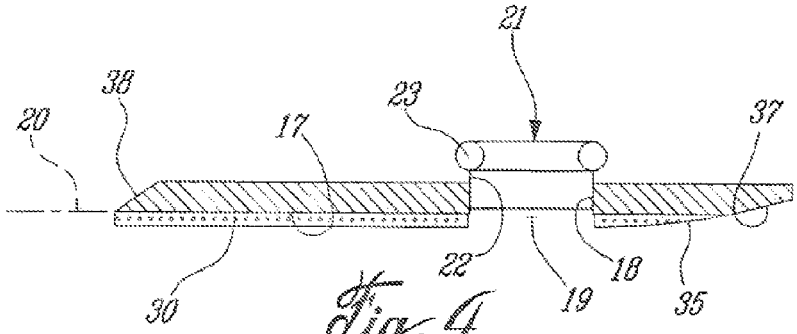
FIG. 4 is a longitudinal sectional side view of the water board showing the circumferential flotation collar assembly fully deployed.
Figure 5:
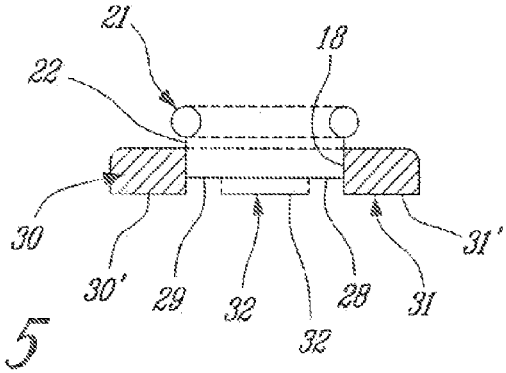
FIG. 5 is a rear end view of the floatable water board.
Figure 10:
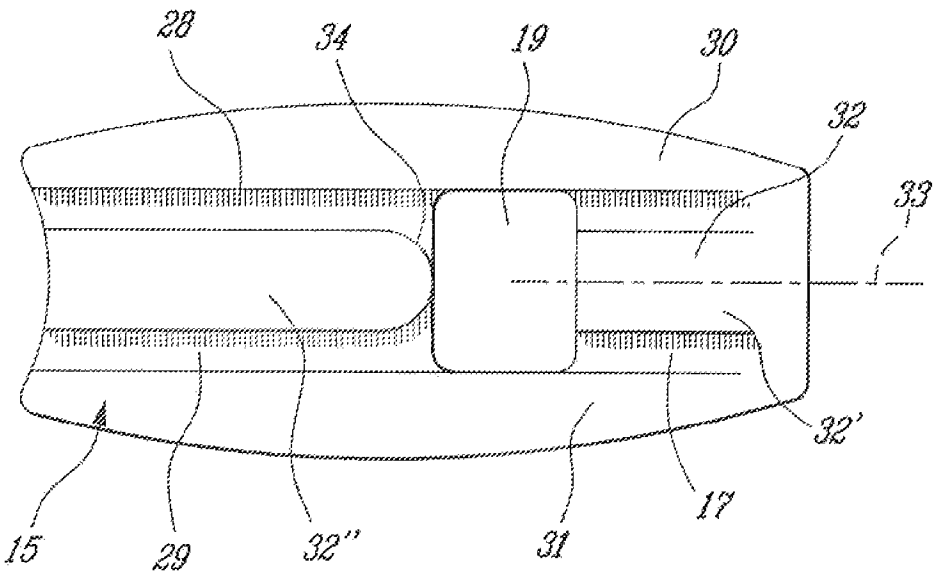
FIG. 10 is a bottom view of the floatable water board as shown in FIG. 1.

Referring now to FIGS. 4, 5 and 10, it can be seen that the bottom surface 17 of the flotation body 13 is provided with longitudinally extending stabilizing rail sections 30, 31 and 32. These rail sections provide for the stability of the board and a more stable directional displacement thereof when displaced on water by channeling water over the bottom surface 17 in longitudinal channels 29 and 28 between the stabilizing rail sections 30, 31 and 32. The channels 28 and 29 have a bottom wall lying in the plane of the bottom surface 17 and directs waterflow against the transparent pane 19 to evacuate air bubbles and therefore prevent the accumulation of air bubbles over the pane whereby to maintain a clear visual surface. As hereinshown, there are three stabilizing rail sections 30, 31 and 32, but it is conceivable that only the rail section disposed on opposed respective sides of the bottom surface 17, namely rails 30 and 31 may be provided. Therefore, the transparent pane 19 would be spaced between the opposed stabilizing side rail sections with water flowing thereover to maintain clear visibility against the pane.

In the embodiment hereinshown there is a central stabilizing rail section 32 extending along the central longitudinal axis 33 of the flotation body 17 and with the central stabilizing rail section 32 defining a front section 32' spaced forwardly of the transparent pane 19 and a rear section 32" spaced rearwardly of the transparent pane 19, as shown in FIG. 10. The rear section 32" is also provided with a curved convex front end section 34 to provide for deflection of the water flowing thereagainst and prevent turbulence which generates air bubbles. The rail sections also have flat outer surfaces 30', 31' and 32' and a sloped downwardly extending front end 35, as shown in FIG. 4.

Figure 7:
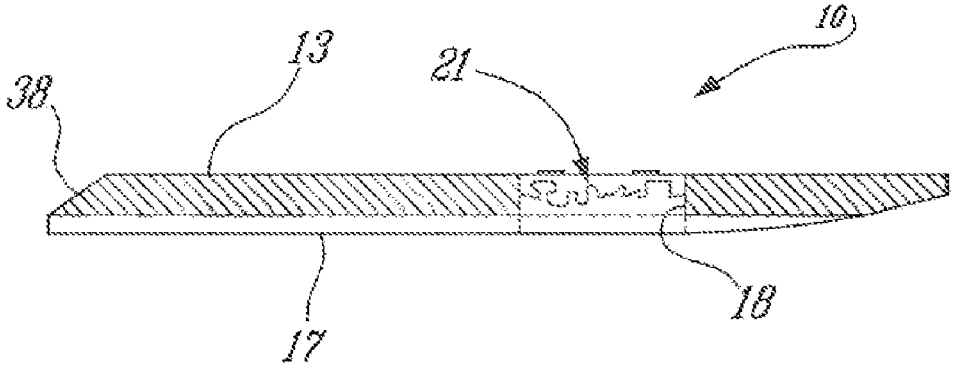
FIG. 7 is a sectional side view illustrating the circumferential flotation collar assembly stored in the viewing cavity.
Figure 8:
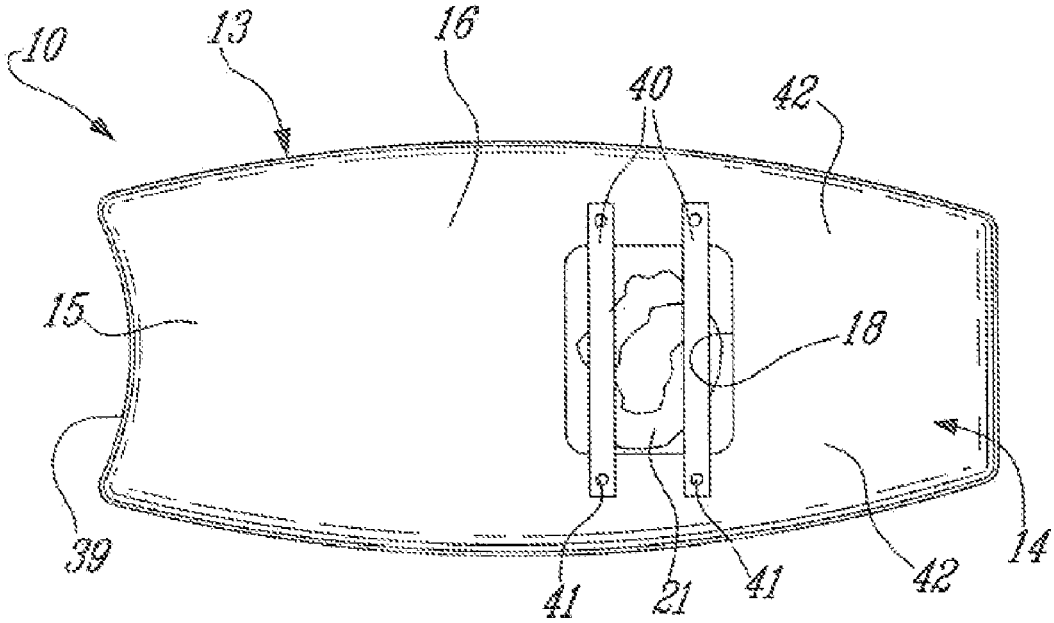
FIG. 8 is a top view of the floatable water board illustrating the fastening straps secured over the viewing cavity to retain the flotation collar assembly in a stored condition in the viewing cavity.

With reference now to FIGS. 7 and 8, it can be seen that the flotation collar assembly 21, when in a deflated condition, is entirely storable in the viewing cavity 18 Restraining means in the form of one or more detachable straps 40 are provided to maintain the flotation collar assembly captive within the viewing cavity 18 and in an unobstructing position with respect to the top surface 16 of the flotation body 13, as better illustrated in FIG. 8. These straps 40 are made of suitable water-resistant material and are detachably connected to fasteners 41 secured to the top surface 16 of the board 13 such as snap fasteners, well known in the art. The fasteners may also be constructed by Velcro™ attachments or other suitable fastening means. These fasteners are secured at predetermined locations with respect to the viewing cavity and as hereinshown there are two snap fasteners secured on opposed sides of the viewing cavity 18 whereby the two straps 40 may be disposed in a spaced-apart arrangement across the cavity to prevent the flotation collar assembly from floating out of the cavity. It is also contemplated that a waterproof sheet can be used instead of straps to cover the cavity entirely. The sheet may be secured all along the periphery of the cavity by Velcro™ strips or snap connectors. Accordingly, the board can now be used as a standard body board for the pleasure of the user person without access to the viewing cavity.

With further reference to FIGS. 1 and 8, it can be seen that snap fasteners 42 are also provided at a predetermined location forwardly of the viewing cavity 18 on a respective side thereof whereby the straps 40 may be secured on opposed sides of the viewing cavity, as shown in FIG. 1, to provide handles for the user person. Also, when the straps are secured across the cavity, as shown in FIG. 8, they provide carrying handles for carrying the water board on land.

Figure 9:
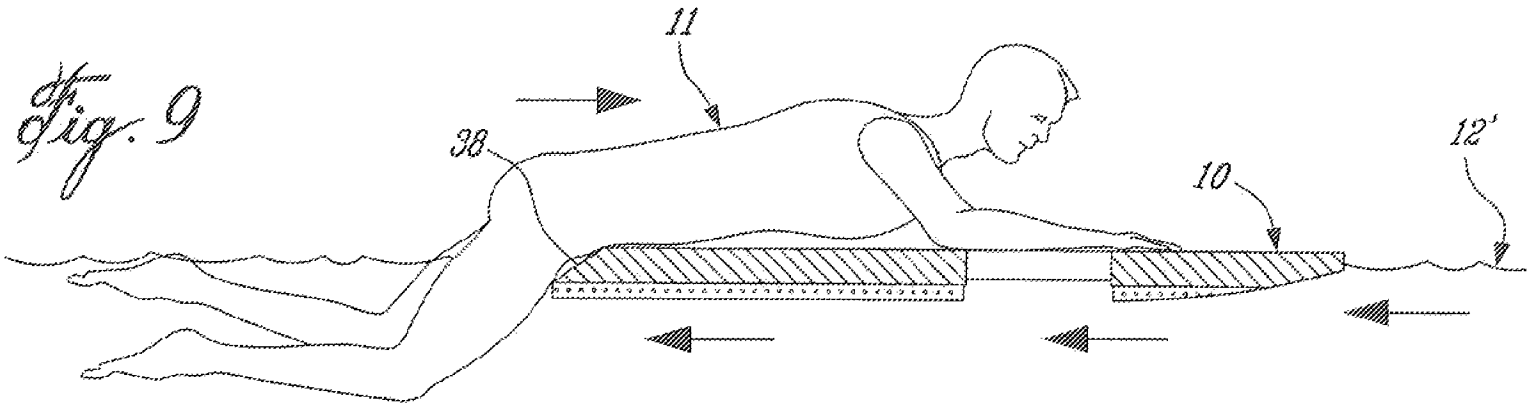
FIG. 9 is a side view illustrating the floatable water board being used by a user person with the flotation collar assembly in a stored condition.

With further reference to FIGS. 9 and 10, it can be seen that the flotation body is shaped and dimensioned to provide comfort and freedom of arm and leg movement to a user person to displace itself on the water board over a body of water. As hereinshown the bow end portion 14 has a sloped downwardly extending surface 37 which merges into the sloped surface 35 of the stabilizing rail sections. The stern end portion 15 also has a downwardly sloped rear end edge 38 which provides comfort for the user person 11. The rear end edge also has a gently concavely curved shape 39, as better seen in FIG. 8, to stabilize the board with the body of the user person.

With reference now to FIGS. 2, 3, 6 and 9, it can be seen that when in use, the upper body portion of a user person is disposed on the rear end portion of the water board 10 and this causes the bow portion of the water board to angulate to a position substantially as shown in FIG. 3, wherein the weight rests on the rear portion of the board causing the bow end portion 14 to rise. With the flotation collar assembly deployed, as shown in FIG. 3, regardless of the angulation of the board the ring-shaped inflatable tubular member 23 remains floating on the top surface 12' of the body of water preventing water from entering the cavity to provide clear vision through the pane 19. FIG. 2 illustrates a user person and its sight of view 40 with respect to the viewing assembly. FIG. 6 shows another use wherein the weight of the user person may cause the entire flotation body 13 to be submerged under the top surface 12' of a body of water. Of course, when the board is used on very choppy water surface, the user person 11 may position its face directly within the ring-shaped inflatable tubular member 23 whereby to prevent water from splashing into the cavity. If water accumulates within the cavity due to rough water conditions, then the user person needs to only flip the board to its side to remove water therefrom should the water affect its clear view through the pane 19. The pane can be constructed of a strong glass sheet or a clear plastic sheet retained by a support collar and gasket (not shown) held in sealing engagement within a circumferential depression formed about the viewing cavity 18 about the bottom surface 17 of the board. Similarly, the waterproof sleeve of the flotation collar assembly may also be secured about the viewing cavity by a waterproof frame 43, as shown in FIG. 1.

It is within the ambit of the present invention to cover any obvious modifications of the preferred embodiment described herein provided such modifications fall within the scope of the appended claims.

I claim:

1. A floatable water board for supporting at least an upper body portion of a user person lying on said board when on a body of water, said board comprising a flotation body constructed of buoyant material; said flotation body defining a bow end portion, a stern end portion, a top surface, and a bottom surface; a viewing cavity in said flotation body disposed at a predetermined location in a forward region of said flotation body, a transparent pane sealingly retained at a bottom end of said viewing cavity and extending substantially in a plane of said bottom surface, and an inflatable circumferential flotation collar assembly secured about said cavity by a flexible and extendible section sealingly engaged about said viewing cavity and deployable above said top surface of said flotation body.

2. A water board as claimed in claim 1 wherein said circumferential flotation collar is a ring-shaped inflatable tubular member.

3. A water board as claimed in claim 2 wherein said flexible and extendible section is constituted by a sleeve of waterproof material sealingly secured about said viewing cavity at a bottom end of said sleeve and sealingly secured to said ring-shaped inflatable tubular member at a top end thereof, said flexible and extendible section providing independent floating displacement of said ring-shaped inflatable tubular member with respect to said top surface of said flotation body.

4. A water board as claimed in claim 1 wherein said bottom surface is provided with longitudinally extending stabilizing rail sections, and one or more longitudinal channels defined between said stabilizing rail sections, said channels having a flat bottom wall lying in the plane of said bottom surface to channel water flow against said transparent pane when displaced on a body of water to prevent accumulation of air bubbles whereby to maintain a clear visual surface over said transparent pane.

5. A water board as claimed in claim 4 wherein there is one of said stabilizing rail sections disposed on a respective side of said bottom surface of said flotation body, said transparent pane being spaced between said stabilizing rail sections.

6. A water board as claimed in claim 5 wherein there is further provided a central stabilizing rail section extending along a central longitudinal axis of said flotation body and equidistantly spaced from each said stabilizing rail sections on said respective sides of said bottom surface, said central stabilizing rail section having a front section spaced forwardly of said transparent pane and a rear section spaced rearwardly of said transparent pane.

7. A water board as claimed in claim 4 wherein said rail sections have a flat outer surface and transverse inner side walls, a front end of each said rail sections defining a sloped downwardly extending surface.

8. A water board as claimed in claim 1 wherein said flotation collar assembly, when in a deflated condition, is entirely storable in said viewing cavity; and restraining means to maintain said flotation collar assembly captive in said viewing cavity.

9. A water board as claimed in claim 8 wherein said restraining means is constituted by one or more straps detachably connected to fastening means secured to said top surface of said flotation body at predetermined locations with respect to said viewing cavity.

10. A water board as claimed in claim 9 wherein said fastening means are snap fasteners, there being snap fasteners secured on opposed sides of said viewing cavity for securing said one or more straps across said viewing cavity.

11. A water board as claimed in claim 10 wherein there are two of said straps with two of said fasteners being disposed on a respective one of said opposed sides of said viewing cavity, and a further fastener secured to said top surface forwardly of said two fasteners on said opposed sides of said viewing cavity for securing each of said two straps along a respective side of said viewing cavity with said flotation collar assembly deployed, said two straps, when secured on a respective side of said viewing cavity constituting handles for the user person when said water board is on a body of water, said straps when secured across said viewing cavity also constituting carrying handles for carrying said water board on land.

12. A water board as claimed in claim 1 wherein said flotation body is shaped and dimensioned to provide freedom of arm and leg movement of the user person to displace said water board on a body of water, said bow end portion having a sloped downwardly extending undersurface.

13. A water board as claimed in claim 12 wherein said stern end portion has a downwardly sloped rear end edge on a top surface of said water board to provide comfort to the user person's body.

14. A water board as claimed in claim 13 wherein said rear end edge is a gently concavely curved rear end edge extending between opposed side edges of said water board.

* * * * *